US008811641B2

(12) United States Patent
Pape et al.

(10) Patent No.: US 8,811,641 B2
(45) Date of Patent: Aug. 19, 2014

(54) HEARING AID DEVICE AND METHOD FOR OPERATING A HEARING AID DEVICE

(75) Inventors: Sebastian Pape, Erlangen (DE); Maja Serman, Erlangen-Buckenhof (DE)

(73) Assignee: Siemens Medical Instruments Pte. Ltd., Singapore (SG)

( * ) Notice: Subject to any disclaimer, the term of this patent is extended or adjusted under 35 U.S.C. 154(b) by 193 days.

(21) Appl. No.: 13/437,042

(22) Filed: Apr. 2, 2012

(65) Prior Publication Data

US 2012/0250919 A1 Oct. 4, 2012

(30) Foreign Application Priority Data

Mar. 31, 2011 (DE) ..... 10 2011 006 511

(51) Int. Cl.
*H04R 25/00* (2006.01)

(52) U.S. Cl.
USPC ..... 381/320; 381/312; 381/318

(58) Field of Classification Search
CPC ... H04R 25/356; H04R 25/453; H04R 25/505
USPC ..... 381/312–331
See application file for complete search history.

(56) References Cited

U.S. PATENT DOCUMENTS

| | | | | |
|---|---|---|---|---|
| 5,204,906 | A | 4/1993 | Nohara et al. | |
| 6,768,801 | B1 | 7/2004 | Wagner et al. | |
| 7,010,133 | B2 | 3/2006 | Chalupper et al. | |
| 2002/0094100 | A1 * | 7/2002 | Kates et al. | 381/318 |
| 2004/0190740 | A1 | 9/2004 | Chalupper et al. | |
| 2009/0112594 | A1 | 4/2009 | Kim et al. | |
| 2011/0004468 | A1 | 1/2011 | Fusakawa et al. | |

FOREIGN PATENT DOCUMENTS

| | | | |
|---|---|---|---|
| DE | 69105154 | T2 | 3/1995 |
| DE | 10308483 | A1 | 9/2004 |
| DE | 102009032238 | A1 | 7/2010 |
| EP | 1175125 | A2 | 1/2002 |
| EP | 1441562 | A2 | 7/2004 |
| WO | 0005923 | A1 | 2/2000 |

OTHER PUBLICATIONS

R. W. Guelke, Journal of Rehabilitation Research and Development, vol. 24, No. 4, pp. 217-220; Fall 1987.*

(Continued)

*Primary Examiner* — Matthew Eason
(74) *Attorney, Agent, or Firm* — Laurence A. Greenberg; Werner H. Stemer; Ralph E. Locher

(57) ABSTRACT

A hearing aid device has an input converter for receiving an input signal and converting the signal into an electrical input signal, a signal processing unit for processing and frequency-dependent amplification of the electrical input signal and generating an electrical output signal, an output converter for converting the electrical output signal into an acoustic output signal, and a sound detector facility for identifying sounds in a signal. Facilities increase an amplification above a normal amplification for a frequency range in which an identified sound contains signal components. Further facilities set the normal amplification of an electrical input signal in dependence on a signal frequency. The amplification is restricted to a maximum amplification in a specific frequency range. The amplification exceeds the normal amplification or the maximum amplification for the duration of the identified sound and at most for a duration which lies below a setting time of a feedback whistling.

8 Claims, 3 Drawing Sheets

(56) References Cited

OTHER PUBLICATIONS

Kennedy et al., "Consonant-Vowel Intensity Ratios for Maximizing Consonant Recognition by Hearing Impaired Listeners", Feb. 1998, pp. 1098-1114, J. Acoust. Soc. Am. 103 (2).

NH Shobha et al., "Experimental Evaluation of Improvement in Consonant Recognition for the Hearing-Impaired Listeners: Role Consonant-Vowel Intensity Ratio", Journal of Theoretical and Applied Information Technology, 2005-2009 JATIT, pp. 101-109.

* cited by examiner

HEARING AID DEVICE AND METHOD FOR OPERATING A HEARING AID DEVICE

CROSS-REFERENCE TO RELATED APPLICATION

This application claims the priority, under 35 U.S.C. §119, of German application DE 10 2011 006 511.3, filed Mar. 31, 2011; the prior application is herewith incorporated by reference in its entirety.

BACKGROUND OF THE INVENTION

Field of the Invention

The invention relates to a hearing aid device and to a method for operating a hearing aid device.

U.S. patent publication No. 2011/004 468 A1 discloses a hearing aid device and a method for operating a hearing aid. The hearing aid has an input converter for receiving an input signal and converting the signal into an electrical input signal. A signal processing unit is provided for processing and frequency-dependent amplification of the electrical input signal and for generating an electrical output signal. An output converter converts the electrical output signal into an output signal which can be perceived by a user as an acoustic output signal. A sound detector facility is provided for identifying sounds in a speech signal going into the hearing aid device. A device is provided for briefly increasing the amplification above a normal amplification for at least one frequency range, in which an identified sound contains signal components.

Published, European patent application EP 1 175 125 A2, corresponding to U.S. Pat. No. 5,706,352, relates to a degree of amplification and filter circuit and discloses an adaptive filter circuit for use in a hearing device by a person with a hearing impairment having a predetermined frequency range. The filter circuit includes a variable filter and an amplifier, which have a bandwidth which corresponds to the predetermined frequency range of the hearing impairment.

Published German patent application DE 10 2009 032 238 A1 discloses a method for monitoring the adjustment of a hearing device, containing a filter bank for the spectral selective amplification and volume compression of audio signals, to a hearing loss of a hearing device wearer. This publication describes a maximum possible amplification in the upper frequency bands by the hearing device and a feedback whistling, which, with unfavorable designs or with leakages, already uses the ear mold in the case of minimal amplifications, which are too minimal for adequate amplification of the fricative energies.

Tight boundaries with respect to the maximum amplification which can be achieved with a hearing aid device are generally set by the required, small size of the device and the minimal distance between the input converter (in particular microphone) and output converter (in particular receiver). The extremely bothersome feedback whistling occurs in the case of excessively high amplification. The feedback tendency of a hearing aid device is frequency-dependent and applies in most cases to the upper range of the frequency range which can be transferred by a hearing aid device.

With many hearing-impaired persons, there is therefore the problem that specific frequency ranges can no longer be adequately perceived even with coverage with a hearing device. With the perception of speech, this results in specific sounds, in particular consonants which contain signal components in the high-frequency signal spectrum with respect to speech, not being understood correctly. So-called fricatives, which are named according to their type of articulation, are particularly affected, for instance "s", "sch", "v", or "z".

In order to compensate for the hearing loss, it is known to transpose the relevant frequency ranges into other frequency ranges which can be better perceived. When implementing a frequency transposition of this type, a distinction is essentially made between two methods: with the frequency shift, a frequency range (e.g. 4 kHz-6 kHz) is moved into another frequency range (e.g. 2 kHz-4 kHz). Contrary to this, in the case of compression, the frequency of the output signal is produced by multiplying the frequency of the input signal with a factor (e.g. 0.75). Nevertheless a frequency compression frequently does not take place starting with 0 Hz, but instead firstly above a determined (knee point) frequency, e.g. 2 kHz.

A method of frequency transposition in a hearing aid device as well as a hearing aid device for implementing a frequency transposition are known from published, European patent application EP 1 441 562 A2.

The frequency transposition has two fundamental disadvantages: on the one hand damage to the original spectral composition of specific consonants and other sounds and on the other hand, relating to the perception, the ability to distinguish between different fricatives, is significantly spectrally impaired.

Methods of speech signal processing are known from the prior art, by which the vowels or consonants can be identified in a speech signal. For instance, German utility model DE 691 05 154 T2 discloses a method of this type, in which a speech signal spectrum is analyzed in order to determine peak values and average values, which are compared with specific threshold values in order to identify vowels and consonants.

U.S. patent publication No. 2009/0112 594 A1 discloses a method in which a distinction is made between pre and postvocalic consonants based on acoustic models.

Unpublished, German patent application DE 103 08 483 A1, corresponding to U.S. Pat. No. 7,010,133, discloses a method for automatically setting the amplification in a hearing aid device, with which during operation, a speech signal level and an interference signal level is determined in several frequency bands of an input signal. The amplification is automatically set as a function of the determined signal level and the signal frequency. Amplification parameters are determined in this way by including a loudness model and a speech intelligibility model.

International patent publication WO 00/05923, corresponding to U.S. Pat. No. 6,768,801, discloses a hearing aid having improved speech intelligibility by frequency-selective signal processing and a method for operating a hearing aid of the type.

SUMMARY OF THE INVENTION

The object of the invention is to improve the understanding of speech in the case of hearing losses, in which specific frequency ranges can no longer be perceived with high sound levels.

According to a first aspect, the invention proposes a hearing aid device that has at least an input converter for receiving an input signal and converting the signal into an electrical input signal, a signal processing unit for processing and frequency-dependent amplification of the electrical input signal and for generating an electrical output signal, an output converter for converting the electrical output signal into an output signal which can be perceived as an acoustic output signal by a user, and a sound detector facility for identifying the sounds in a speech signal going into the hearing aid device. Facilities are provided for briefly increasing the amplification above a normal amplification for at least one frequency range, in which an identified sound contains signal components. Facilities are provided for setting the normal amplification of an electrical input signal in dependence on the signal frequency. The amplification is restricted to a permanently possible maximum amplification at least in a specific frequency range. The amplification can be set such that this exceeds the normal amplification or the permanently possible maximum amplification at least essentially for the duration of the identified sound. The amplification can be set such that this exceeds the normal amplification or the permanently possible maximum amplification at most for a duration which lies below a setting time of a feedback whistling.

According to a second aspect, the invention proposes a method for operating a hearing aid device having at least an input converter for receiving an input signal and converting the signal into an electrical input signal, a signal processing unit for processing and frequency-dependent amplification of the electrical input signal and for generating an electrical output signal, and an output converter for converting the electrical output signal into an output signal which can be perceived as an acoustic output signal by a user. Sounds are identified in a speech signal going into the hearing aid device. The amplification is briefly increased above a normal amplification for at least one frequency range in which an identified sound contains signal components. The normal amplification of an electrical input signal is set as a function of the signal frequency. The amplification is restricted to a permanently possible maximum amplification at least in one specific frequency range. The amplification exceeds the normal amplification or the permanently possible, maximum amplification at least essentially for the duration of the identified sound. The amplification exceeds the normal amplification or the permanently possible, maximum amplification at most for a duration which lies below a setting time of a feedback whistling.

A hearing aid device according to the invention is understood to mean each device which provides an output signal which can be perceived as an acoustic signal by a user or contributes to providing such an output signal and which has means for compensating for an individual hearing loss of the user. In particular, this is a hearing device which can be worn on the body or on the head, in particular on or in the ear, or can be wholly or partially implanted. Such devices are however also included, the predominant purpose of which does not lie in compensating for a hearing loss, for instance electronic entertainment devices (televisions, hifi systems, MP3 players etc), or communication devices (mobile telephones, PDAs, headsets etc.) which nevertheless have means for compensating for an individual hearing loss.

A hearing aid device generally includes an input converter for receiving an input signal. The input converter is embodied for instance as a microphone which receives an acoustic signal and converts the same into an electrical input signal. Units are however also considered as input converters which comprise a coil or an antenna and which receive an electromagnetic signal and convert the same into an electrical input signal. Furthermore, a hearing aid device usually includes a signal processing unit for processing and frequency-dependent amplification of the electrical input signal. A preferably digital signal processor (DSP), the mode of operation of which can be influenced by programs or parameters which can be transmitted to the hearing aid device, is used for signal processing in the hearing aid device. As a result, the mode of operation of the signal processing unit can adjust both to the individual hearing loss of a hearing aid device wearer and also to the current audio situation, in which the hearing aid device is currently operated. The thus changed electrical input signal is finally fed to an output converter. This is generally embodied as a receiver, which converts the electrical output signal into an acoustic signal. Nevertheless, other embodiments are also possible here, e.g. an implantable output converter, which is directly connected to an auditory ossicle and prompts the same to vibrate.

With a hearing aid device, the amplification is set such that the individual hearing loss of a user is compensated. The amplification needed for this is usually dependent on the signal frequency. Physical boundaries are however set with respect to the maximum adjustable amplification, the boundaries on the one hand resulting from the technical possibilities of the hearing aid device used and on the other hand being used to prevent feedback. Feedback occurs in most cases in the upper frequency range which can be transmitted by a hearing aid device. Many hearing aid device wearers unluckily have significant hearing loss in this frequency range, for the compensation of which a high amplification would be necessary. To prevent feedback, the amplification is therefore set in a relevant frequency range such that the relevant hearing device can still be operated in a stable fashion, even if the amplification needed to compensate for the individual hearing loss can no longer be achieved. Furthermore, with the so-called power devices, which enable very high amplification by avoiding acoustic feedback, upper boundaries are set for the amplification on account of the mechanical stability of the devices.

According to the invention, aside from the usual components (input converter, signal processing unit, output converter) the hearing aid device has a sound detector facility for identifying sounds, in particular components, in a speech signal going into the hearing aid device.

A sound is generally a noise or a tone, caused by the human or animal voice. In general linguistics, a sound in the narrower sense is a defined acoustic wave produced with the flow of breath (phonation flow) when the organs of speech are in a specific position. The generation and perception of sounds forms the subject matter of phonetics. A speech sound and/or phone is understood there as the smallest, phonetic unit of the spoken language.

Within the meaning of the invention, a consonant is generally understood to mean a sound, the articulation of which contains a narrowing of the vocal tract, so that the flow of breath is wholly or partially blocked and results in audible turbulences. Consonants are sounds overcoming obstacles. In particular, within the meaning of the invention consonants are not restricted to the consonant letters (B, C, D, F etc).

With an identified sound, in particular a consonant or fricative, which has signal components in a frequency range in which the amplification needed to compensate for the individual hearing loss can no longer be permanently achieved, the invention now provides to briefly increase, in particular for the duration of the sound, the amplification above the permanently possible amplification. As a result, it is possible for the hearing aid device wearer to better perceive the sound and thus better understand the overall speech.

In conjunction with the invention, it is insignificant whether the desired amplification cannot be permanently achieved, because this would exceed the permanently possible maximum output power of the final amplifier in the relevant frequency range, or whether the amplification was restricted in order to prevent feedback to protect the mechanical stability of the relevant device. With respect to the final amplifier, it is namely possible to briefly increase the output power above the permanently possible maximum output power without herewith causing damage. With respect to the feedback problem or the mechanical stability, a brief exceedance of the permanently maximum permissible amplification is also unproblematic, since, e.g. the unwanted feedback whistling requires a certain setting time, rather than rendering the same bothersomely noticeable. The duration of a sound nevertheless lies below this setting time.

In a preferred embodiment of the invention, provision is made to split the electrical input signal into several parallel frequency bands (channels) and the signal processing in the hearing aid device in the signal processing unit takes place at least partially in parallel in the individual frequency bands. Advantageously as a function of an identified sound, the amplification is then increased above the normal amplification at least for a specific frequency band, if the desired amplification cannot be achieved permanently on account of the already cited reasons and the identified sound contains signal components in the relevant frequency band.

The invention is advantageous in that, contrary to a frequency compression, the clarity of speech is not impaired to any degree.

Other features which are considered as characteristic for the invention are set forth in the appended claims.

Although the invention is illustrated and described herein as embodied in a hearing aid device and a method for operating a hearing aid device, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1:
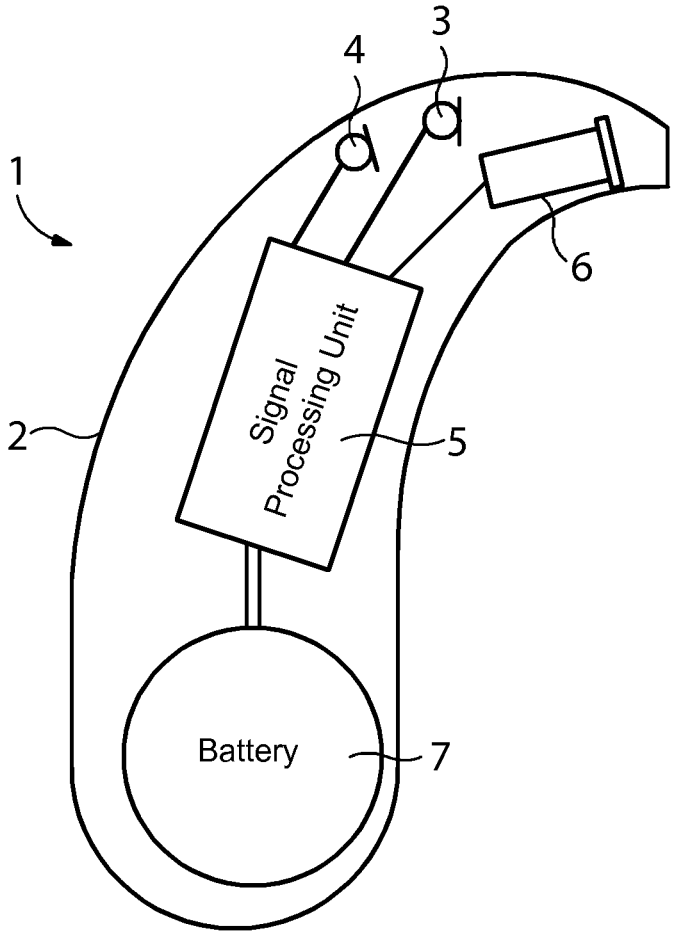
FIG 1 PRIOR ART
FIG. 1 is a simplified block diagram of a hearing aid device according to the prior art.

Referring now to the figures of the drawing in detail and first, particularly, to FIG. 1 thereof, there is shown a simplified block diagram of the structure of a hearing aid device according to the prior art. As essential components, hearing aid devices in principle exhibit one or more input converters, an amplifier and an output converter. The input converter is generally a receiving transducer, e.g. a microphone or an electromagnetic receiver, e.g. an induction coil. The output converter is in most cases realized as an electroacoustic converter, e.g. miniature loudspeaker and/or receiver, or as an electromechnical converter, e.g. bone conduction receiver. The amplifier is usually integrated into a signal processing unit. This basic design is shown in FIG. 1 with the example of a behind-the-ear hearing device 1. Two microphones 3 and 4 for receiving the sound from the ambient are integrated into a hearing device housing 2 to be worn behind the ear. A signal processing unit 5, which is likewise integrated into the hearing device housing 2, processes and amplifies the microphone signals. The output signal of the signal processing unit 5 is transmitted to a loudspeaker and/or receiver 6, which outputs an acoustic signal. The sound is if necessary transmitted via an acoustic tube, which is fixed with an ear mold in the auditory canal, to the eardrum of the hearing device wearer. Power is supplied to the hearing device and in particular to the signal processing unit 5 by a battery 7 which is likewise integrated into the hearing device housing 2.

Figure 2:
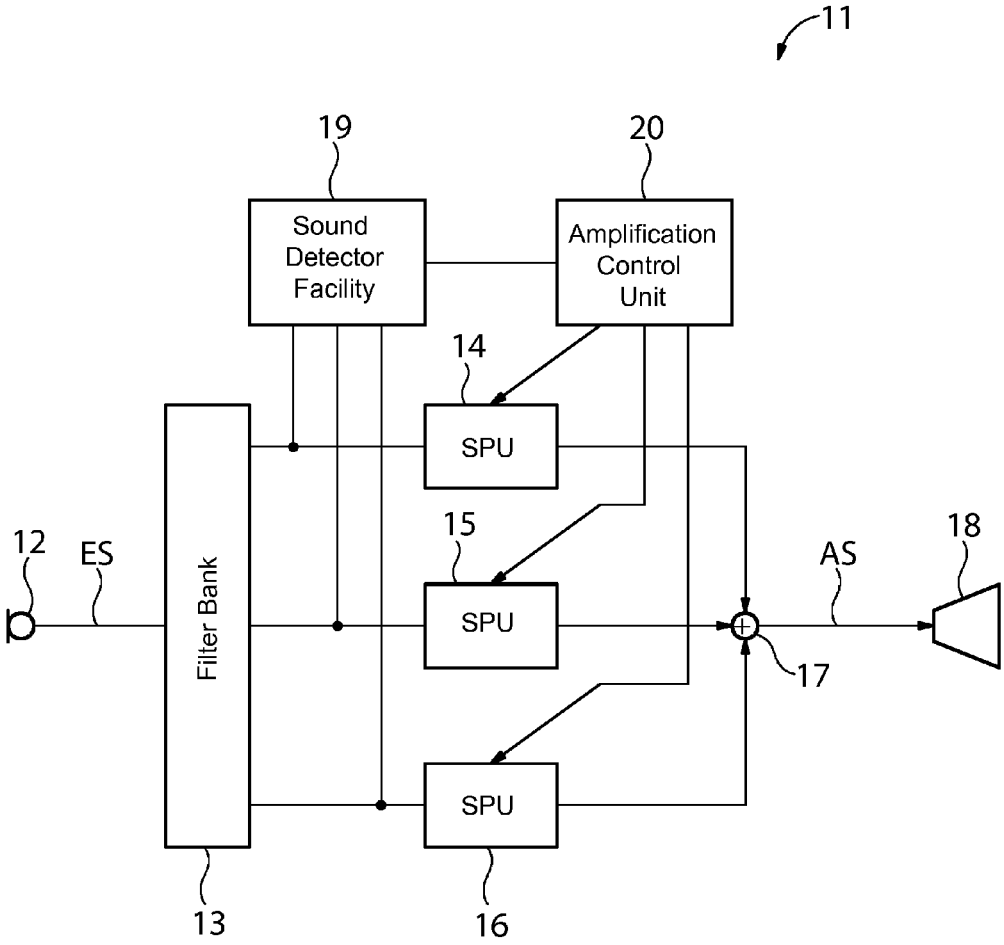
FIG. 2 is a block diagram for setting an amplification in dependence on an identified sound.

FIG. 2 shows a significantly simplified block diagram of an electrical output signal AS, such as is generated from an electrical input signal ES, which if necessary contains a speech signal. To this end, the acoustic input signal received by a microphone 12 is initially converted into an electrical input signal ES and fed to a filter bank 13. The filter bank 13 causes the electrical input signal ES to split into several (in the exemplary embodiment three) parallel channels. The further signal processing for compensating for the individual hearing loss of a user subsequently takes place in parallel in three channels, in particular in the signal processing units 14, 15 and 16, before the processed signals are combined again in a summing unit 17. A receiver 18 finally converts the resulting electrical output signal AS into an acoustic output signal.

An amplification is set for each channel by a corresponding setting of parameters, by which the individual hearing loss of the user is balanced out. As a function of the individual degree of hearing loss, complete compensation for the hearing loss is however frequently not possible. Instead, the amplification must in some circumstances be reduced to a maximum degree in order to prevent an overload of the amplifier included by the relevant signal processing unit or to prevent the occurrence of feedback. A permanently possible, maximum amplification is therefore set for each channel 14, 15 and/or 16 as a normal amplification, the maximum amplification not overloading the relevant amplifier and thereby ensuring stable operation.

As a distinctive feature, the hearing aid device according to the invention includes a sound detector facility 19 which is known per se to identify sounds, in particular consonants, in a speech signal contained in the input signal. If a specific sound, for instance a consonant, was identified, a signal in this regard is forwarded to an amplification control unit 20. The amplification performed in the individual channels by the signal processing units 14, 15 and 16 is now adjusted to the identified sound by the amplification control unit 20. It is possible here for the amplification to briefly exceed the "normal" and in particular also the permanently possible maximum amplification, in particular for the duration of the identified sound.

Figure 3:
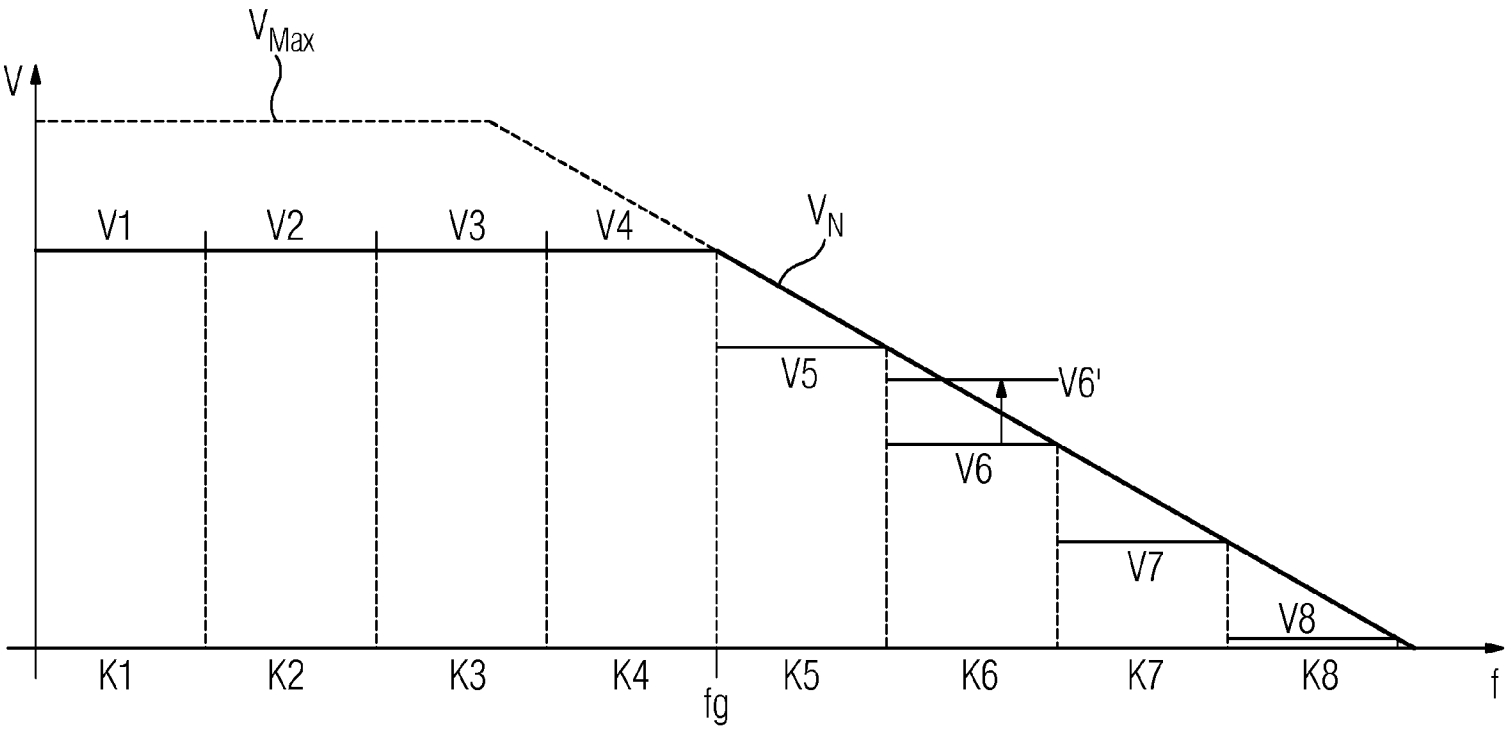
FIG. 3 is a graph showing an amplification set according to the invention in dependence on the signal frequency.

FIG. 3 explains the described procedure again with the aid of the indicated amplification V in dependence on the signal frequency f. A hearing aid device with 8 frequency bands (channels) K1 to K8 forms the basis of the exemplary embodiment according to FIG. 3. A characteristic curve, which, partially for technical reasons and also partially dependent on individual factors of the relevant hearing aid device wearer, is visible above the frequency f. In the exemplary embodiment, the amplifications V1 to V8 are set for the individual channels, which form the characteristic curve of the "normal" amplification $V_N$ above the frequency f. $V_N \leq V_{Max}$ always plies so that stable operation is always ensured and the amplifier of the hearing aid device is not overloaded. In the exemplary embodiment, the amplifications V6 to V8 which are set in the channels K6 and K8 should no longer completely compensate for the individual hearing loss of the user.

Provision is now made according to the invention that as a result of an identified sound, the amplification briefly exceeds the normal amplification $V_N$ and/or the maximum amplification $V_{Max}$, in particular for the duration of the sound. This is indicated in FIG. 3 for the channel K6, for which a short-term amplification (briefly) assumes the value V6'.

The degree by which the short-term amplification V6' exceeds the normal amplification $V_N$ may depend on various factors. In particular, it depends on the signal strength of the identified sound in the input signal. On the other hand, it is also restricted to a maximum value on account of technical restrictions. The maximum value of the short-term amplification advantageously lies about a specific degree, e.g. 5 dB, above the permanently achievable maximum amplification $V_{Max}$. This measure can advantageously be set in particular also in a channel-dependent fashion, by programming the relevant hearing aid device.

The duration of the short-term amplification is advantageously adjusted to the duration of the identified sound. In particular, the duration of the short-term amplification essentially corresponds to the duration of the identified sound.

By means of the invention, the speech intelligibility, particularly in the case of significant hearing losses, is increased without in this way increasing the feedback tendency. It may contribute to avoiding an unwanted frequency transposition in the case of significant hearing losses on account of its serious disadvantages.

The invention claimed is:

1. A hearing aid device, comprising:

an input converter for receiving an input signal and converting the input signal into an electrical input signal;

a signal processing unit for processing and frequency-dependent amplification of the electrical input signal and for generating an electrical output signal;

an output converter for converting the electrical output signal into an output signal which can be perceived by a user as an acoustic output signal;

a sound detector facility for identifying sounds in a speech signal going into the hearing aid device;

means for briefly increasing an amplification above a normal amplification for at least one frequency range, in which an identified sound contains signal components;

means for setting the normal amplification of the electrical input signal in dependence on a signal frequency, whereby:

the amplification is restricted to a permanently possible, maximum amplification at least in a specific frequency range;

the amplification being set such that the amplification exceeds the normal amplification or the permanently possible, maximum amplification at least essentially for a duration of the identified sound; and the amplification can be set such that the amplification exceeds the normal amplification or the permanently possible, maximum amplification at most for a duration which lies below a setting time of a feedback whistling.

2. The hearing aid device according to claim 1, wherein fricatives can be identified by means of said sound detector facility.

3. The hearing aid device according to claim 1, wherein the amplification can be increased at least for a duration of the identified sound.

4. The hearing aid device according to claim 1, wherein the electrical input signal is split into several parallel frequency bands and signal processing in the hearing aid device in the signal processing unit takes place at least partially in parallel in the frequency bands individually and whereby in dependence on the identified sound, the amplification can be increased above the normal amplification at least for a frequency band.

5. A method for operating a hearing aid device, which comprises the steps of:

receiving, via one input converter, an input signal and converting the input signal into an electrical input signal;

providing a signal processing unit for processing and frequency-dependent amplifying the electrical input signal and generating an electrical output signal;

converting, via an output converter, the electrical output signal into an output signal which can be perceived as an acoustic output signal by a user;

identifying sounds in a speech signal going into the hearing aid device;

briefly increasing an amplification above a normal amplification for at least one frequency range in which an identified sound contains signal components;

setting the normal amplification of the electrical input signal in dependence on a signal frequency; and restricting the amplification to a permanently possible maximum amplification at least in a specific frequency range, the amplification exceeding the normal amplification or the permanently possible maximum amplification at least essentially for a duration of the identified sound and the amplification exceeding the normal amplification or the permanently possible maximum amplification at most for a duration which lies below a setting time of a feedback whistling.

6. The method according to claim 5, which further comprises identifying fricatives by means of a sound detector facility.

7. The method according to claim 5, which further comprises increasing the amplification at least for a duration of the identified sound.

8. The method according to claim 5, which further comprises splitting the electrical input signal into several parallel frequency bands and a signal processing in the hearing aid device in the signal processing unit takes place at least partially in parallel with the frequency bands individually and whereby in dependence on the identified sound, the amplification is raised above the normal amplification at least for a frequency band.

* * * * *